US011132970B2

(12) United States Patent
Shan

(10) Patent No.: US 11,132,970 B2
(45) Date of Patent: Sep. 28, 2021

(54) DRIVING DEVICE, DRIVING METHOD OF DISPLAY PANEL, AND DISPLAY APPARATUS

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/981,689

(22) PCT Filed: Feb. 27, 2019

(86) PCT No.: PCT/CN2019/076212
§ 371 (c)(1),
(2) Date: Sep. 16, 2020

(87) PCT Pub. No.: WO2020/155262
PCT Pub. Date: Aug. 6, 2020

(65) Prior Publication Data

US 2021/0005153 A1 Jan. 7, 2021

(30) Foreign Application Priority Data

Jan. 30, 2019 (CN) ..... 201910098356.6

(51) Int. Cl.
*G09G 3/36* (2006.01)

(52) U.S. Cl.
CPC ..... *G09G 3/3677* (2013.01); *G09G 3/3614* (2013.01); *G09G 3/3688* (2013.01);
(Continued)

(58) Field of Classification Search
None
See application file for complete search history.

(56) References Cited

U.S. PATENT DOCUMENTS

2006/0050011 A1* 3/2006 Kamio ..... G09G 3/3666 345/1.1
2009/0109357 A1 4/2009 Liu et al.
(Continued)

FOREIGN PATENT DOCUMENTS

CN 104599657 A 5/2015
CN 106098012 A 11/2016
(Continued)

OTHER PUBLICATIONS

First Office Action in counterpart Chinese Application No. 201910098356.6, dated Feb. 3, 2020.
(Continued)

*Primary Examiner* — Christopher J Kohlman
(74) *Attorney, Agent, or Firm* — Westbridge IP LLC

(57) ABSTRACT

Disclosed are a driving device, a driving method and a display apparatus of a display panel, the display array of which has two kinds of gate driving lines for sub-pixels in the same row. The pixels in the odd-numbered column has a different gate driving signals with those in the even-numbered column. The driving time sequence of the main gate driving signals is the original gates driving time sequence corresponding to the low voltage subpixels in the row direction, and the driving time sequence of the sub-gate driving signals is the gate driving time sequence and the source driving time sequence corresponding to the previous high voltage subpixels that is adjacent to the low voltage subpixels. As such, the charging capability is different of sub-pixels on two adjacent rows of gate driving lines for the same drive voltage.

20 Claims, 6 Drawing Sheets

(52) U.S. Cl.
CPC ... *G09G 3/3607* (2013.01); *G09G 2300/0439* (2013.01); *G09G 2310/08* (2013.01); *G09G 2320/0242* (2013.01)

(56) References Cited

U.S. PATENT DOCUMENTS

| | | | | |
|---|---|---|---|---|
| 2010/0001940 | A1* | 1/2010 | Lee | G09G 3/3659 345/90 |
| 2014/0049713 | A1* | 2/2014 | No | G02F 1/13306 349/41 |

FOREIGN PATENT DOCUMENTS

| | | | |
|---|---|---|---|
| CN | 107065354 | A | 8/2017 |
| CN | 107741660 | A | 2/2018 |
| CN | 108831405 | A | 11/2018 |
| KR | 20080044397 | A | 5/2008 |

OTHER PUBLICATIONS

International Search Report and Written Opinion in corresponding PCT Application No. PCT/CN2019/076212, dated Nov. 1, 2019.

* cited by examiner

DRIVING DEVICE, DRIVING METHOD OF DISPLAY PANEL, AND DISPLAY APPARATUS

CROSS REFERENCE TO RELATED APPLICATIONS

The present application is the National Stage of International Application No. PCT/CN2019/076212, filed Feb. 27, 2019, which claims the priority of Chinese patent application filed in the National Intellectual Property Administration on Jan. 30, 2019, with the application number 201910098356.6 and Title "driving device, driving method of display panel and display apparatus", the entire contents of which are hereby incorporated by reference.

TECHNICAL FIELD

The present application relates to the field of liquid crystal panel display, in particular to a driving device, a driving method of a display panel, and a display apparatus.

BACKGROUND

The statements herein merely provide background information related to the present application and do not necessarily constitute prior art.

Most large-size liquid crystal display panels introduce negative Vertical Alignment (VA) or In Panel Switching (IPS). Compared with IPS technology, VA technology has a higher productivity and a lower manufacturing cost. Nevertheless, VA also takes on some obvious optical defects relatively to the IPS technology. For example, color shift may likely take place in a VA LCD panel, when large viewing angle images are presented.

When displaying an image, the brightness of a pixel may change linearly with voltage in an ideal scenario, so that the brightness is reflected by the driving voltage of a pixel which can accurately represent the gray scale of the pixel. When VA technology is utilized in the LCD, if the display surface is viewed at a small viewing angle (e.g. viewing at front), the pixel brightness may fit in the ideal scenario, i.e. brightness changes linearly with voltage; however, if the display surface is viewed at a relatively large angle (e.g. 160 degrees relative to the display surface), the pixel brightness saturates with the voltage rapidly and changes slowly afterwards, due to the limitation of VA technology itself. As such, the gray scale which the driving voltage should have represented, has seriously deviated under a large viewing angle, resulting in the color shift.

An exemplary technique for improving color shift is to subdivide each subpixel into a main pixel and a sub-pixel, followed by driving the main pixel with a relatively high driving voltage and the sub-pixel with a relatively low driving voltage, in which the main pixel and the sub-pixel are jointly displayed as the subpixel. Further, the correspondence between the brightness and its gray scale would remain unchanged at the front view, when the main pixel and sub-pixel are respectively driven by a relatively high driving voltage and a relatively low driving voltage. In general, in the first half of the gray scale, the main pixel is displayed driven by a relatively high driving voltage while the sub-pixel is not displayed. Thus, the brightness of the entire subpixel is half of the brightness of the main pixel. In the second half of the gray scale, the main pixel is displayed driven by a relatively high driving voltage and the sub-pixel is displayed by a relatively low driving voltage. Thus, the brightness of the entire subpixel is a halved sum of the brightness of the main pixel and the sub-pixel. Synthesized in this manner, the brightness curve at a large viewing angle is closer to the ideal curve, and the color shift has been improved.

However, it requires to double wire traces as well as driving devices to drive the sub-pixels by the aforementioned method. The transparent opening area has to be sacrificed, thereby affecting the light transmittance of the panel. And the cost further goes up.

SUMMARY

The present application is to provide a driving method, driving device, display apparatus and a storage medium, aiming at improving the color shift of the current display panel.

For such purpose, the present application provides a driving device for a display panel, in which the display panel includes a display array. The display array includes pixels arranged in an array, and each pixel includes three subpixels sequentially arranged in a row direction. Pixels in an odd-numbered column have different gate driving signals as pixels in an even-numbered column in the row direction. The different gate driving signals includes a main gate driving signal and a signal combining the main gate driving signal and the sub-gate driving signal, in which the subpixel having the main gate driving signal is named as a high voltage subpixel, and the subpixel having the signal combining the main gate driving signal and the sub-gate driving signal is named as a low voltage subpixel. And the driving device includes a gate driving element and a source driving element.

The gate driving element, is configured to transmit a sub-gate driving signal to the low voltage subpixel arranged in the row direction; open a sub-gate switch corresponding to the scanned low voltage subpixel when the sub-gate driving signal scans to the low voltage subpixel, allowing the source driving element applies a first source driving signal to the low voltage subpixel. The first source driving signal is the source driving signal of a previous high voltage subpixel which is adjacent to the low voltage subpixel, in which, the driving time sequence of the sub-gate driving signal is the gate driving time sequence and the source driving time sequence corresponding to the previous high voltage sub-pixel which is adjacent to the low voltage subpixel;

the gate driving element, is configured to transmit the main gate driving signal to the low voltage subpixel arranged in the row direction, open a main gate switch corresponding to the low voltage subpixel, when the main gate driving signal scans to the low voltage sub-pixel, allowing the source driving element applies a second source driving signal to the low voltage subpixel, in which a driving time sequence of the main gate driving signal is an original gate driving time sequence corresponding to the low voltage sub-pixel arranged in the row direction.

In some embodiments, the gate driving element, is further configured to simultaneously send in the row direction the sub-gate driving signal and the main gate driving signal to scan the low voltage sub-pixel.

In some embodiments, the subpixels in an odd row in column i share a same source line with the subpixels in an even row in column i+1, in which i is odd, and one source line corresponds to one source driving signal; in which, the subpixels in an odd row in column i share a same source line with the subpixels in an even row in column i+1, in which i is odd, and one source line corresponds to one source driving signal.

The gate driving element, is further configured to simultaneously send in the row direction the sub-gate driving signal and the main gate driving signal to scan the low voltage sub-pixel.

In some embodiments, the polarity of the driving voltage of the first source driving signal is opposite to the polarity of the driving voltage of the second source driving signal.

In some embodiments, polarity of subpixels at a same row is the same, and the polarity of subpixels at two adjacent rows is opposite.

In addition, to achieve objective aforementioned, the present application further provides a driving method of a display panel, in which the display panel includes a display array including pixels arranged in an array, each pixel includes three subpixels sequentially arranged in a row direction, in which pixels in an odd-numbered column have different gate driving signals as pixels in an even-numbered column in the row direction, and the different gate driving signals includes a main gate driving signal and a signal combining the main gate driving signal and the sub-gate driving signal.

The driving method includes:

transmitting a sub-gate driving signal to the low voltage subpixel arranged in the row direction; opening a sub-gate switch corresponding to the scanned low voltage subpixel when the sub-gate driving signal scans to the low voltage subpixel in the row direction, to apply a first source driving signal to the low voltage subpixel, in which the first source driving signal is the source driving signal of a previous high voltage subpixel which is adjacent to the low voltage subpixel, and the driving time sequence of the sub-gate driving signal is the gate driving time sequence and the source driving time sequence corresponding to the previous high voltage sub-pixel which is adjacent to the low voltage subpixel;

transmitting the main gate driving signal to the low voltage subpixel arranged in the row direction, open a main gate switch corresponding to the low voltage subpixel when the main gate driving signal scans to the low voltage sub-pixel, to apply a second source driving signal to the low voltage subpixel, allowing two adjacent pixels are respectively a high voltage pixel and a low voltage pixel that are alternatively arranged, in which a driving time sequence of the main gate driving signal is an original gate driving time sequence corresponding to the low voltage sub-pixel arranged in the row direction.

In some embodiments, the driving method further includes: driving two adjacent subpixels in a same column by the preset data driving signal, the preset data driving signal being an average of historical driving signals of two sub-pixels that are adjacent.

In addition, in order to achieve the objective aforementioned, the embodiments further provide a display apparatus, in which the display apparatus includes a display panel and a display apparatus of the display panel.

The display panel includes a display array which includes pixels arranged in an array. Each pixel includes three subpixels sequentially arranged in a row direction, and pixels in an odd-numbered column have different gate driving signals as pixels in an even-numbered column in the row direction. The different gate driving signals includes a main gate driving signal and a signal combining the main gate driving signal and the sub-gate driving signal.

The driving device of the display panel includes a processor and a memory, in which the memory stores executable instructions, and the processor executes the executable instructions. The executable instructions include:

transmitting a sub-gate driving signal to the low voltage subpixel arranged in the row direction; opening a sub-gate switch corresponding to the scanned low voltage subpixel, when the sub-gate driving signal scans to the low voltage subpixel in the row direction, to apply a first source driving signal to the low voltage subpixel, in which the first source driving signal is the source driving signal of a previous high voltage subpixel which is adjacent to the low voltage subpixel, and the driving time sequence of the sub-gate driving signal is the gate driving time sequence and the source driving time sequence corresponding to the previous high voltage sub-pixel which is adjacent to the low voltage subpixel.

transmitting the main gate driving signal to the low voltage subpixel arranged in the row direction, open a main gate switch corresponding to the low voltage subpixel, when the main gate driving signal scans to the low voltage sub-pixel, to apply a second source driving signal to the low voltage subpixel, allowing two adjacent pixels are respectively a high voltage pixel and a low voltage pixel that are alternatively arranged, in which, a driving time sequence of the main gate driving signal is an original gate driving time sequence corresponding to the low voltage sub-pixel arranged in the row direction.

According to the present application, the display array of the display panel has two kinds of gate driving lines for sub-pixels in the same row. The pixels in the odd-numbered column has a different gate driving signals with those in the even-numbered column. The driving time sequence of the main gate driving signals is the original gates driving time sequence corresponding to the low voltage subpixels in the row direction, and the driving time sequence of the sub-gate driving signals is the gate driving time sequence and the source driving time sequence corresponding to the previous high voltage subpixels that is adjacent to the low voltage subpixels. As such, the charging capability is different of sub-pixels on two adjacent rows of gate driving lines for the same drive voltage, and adjacent pixels are applied with high and low voltage intensities respectively and alternatively. The difference between high voltage subpixels and low voltage subpixels cannot be obviously distinguished by naked eyes, preventing the resolution from being lowered.

Figure 1:
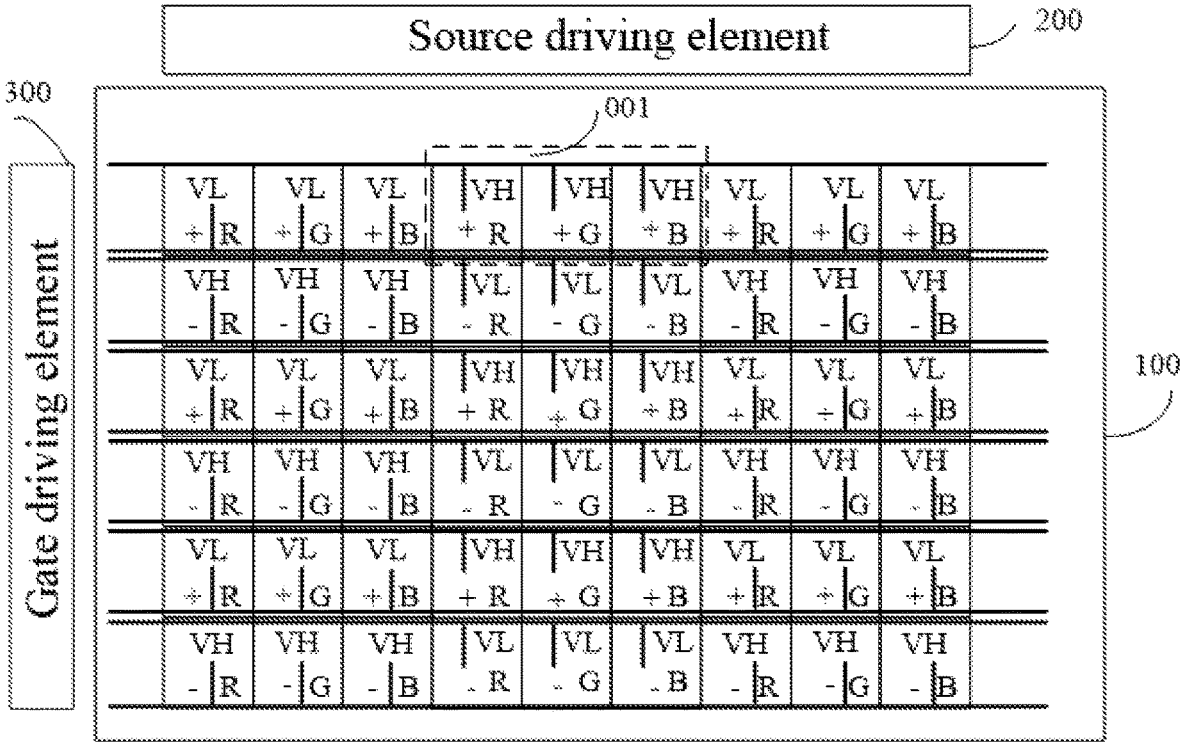
FIG. 1 is a schematic diagram regarding a driving device of a display panel in some embodiments according to the present application.

The implementation, functional characteristics and advantages of the present application will be further described with reference to the attached drawings in combination with embodiments.

DETAILED DESCRIPTION OF THE EMBODIMENTS

It should be understood that the specific embodiments described herein are only for the purpose of explaining the present application and are not intended to limit the present application.

The technical solution in the embodiment of the present application will be described clearly and completely in the following with reference to the drawings in the embodiment of the present application. Obviously, the described embodiment is only a part of the embodiment of the present application, but not all of the embodiments. Based on the embodiments in the present application, all other embodiments perceived by those ordinary skills in the art without creative effort should be included within the protection scope of the present application. Changes in the illustrated shape can be expected as a outcome of manufacturing techniques and/or tolerances. Therefore, the embodiments of the present application should not be interpreted as being limited to the specific shape of the region illustrated herein, but include deviations in shape, for example brought by manufacturing. Therefore, the regions illustrated in the figures are schematic in nature, and their shapes are not intended to show the precise shape of the regions, and to limit the scope of the embodiments.

In the description of this application, it is to be understood that the orientation or positional relationship indicated by the terms of "vertical", "lateral", "upper", "lower", "left", "right", "horizontal", "both sides", "bottom", "middle", "inner", etc. is based on the orientation or positional relationship illustrated in the drawings, with the purpose only for convenience as well as simplification of description of the present application, and does not indicate or imply that the indicated device or element has to have a specific orientation, or be constructed and operated in a specific orientation, and therefore cannot be understood as a limitation of the present application.

In addition, terms regarding "first", "second" and the like in the present application are for descriptive purposes only, and cannot be understood as indicating or implying its relative importance or implicitly indicating a number of technical features indicated. In the description of this application, unless otherwise stated, "multiple" and "plurality of" mean two or more than two.

In addition, the term "comprising" and any variations thereof are intended to cover a non-exclusive inclusion.

Referring to FIG. 1, which is a schematic diagram regarding a driving device of a display panel in some embodiments according to the present application.

In some embodiments, the display panel includes a display array 100 which further includes pixels 001 arranged in an array. Each pixel 001 includes three subpixels arranged in sequence in the row direction, and pixels in the odd-numbered column have different gate driving signal as those in the even-numbered column in the row direction. The different gate driving signals includes a main gate driving signal and a signal combining a main gate driving signal and a sub-gate driving signal. The drive device includes a gate driving element 300 and a source driving element 200.

Specifically, as illustrated in FIG. 1, one pixel includes a R subpixel (red), a G subpixel (green), and a B subpixel (blue), which are sequentially arranged in the row direction.

Accordingly, the gate driving element 300, is configured to transmit a sub-gate driving signal to the low voltage subpixel arranged in the row direction; open a sub-gate switch corresponding to the scanned low voltage subpixel, when the sub-gate driving signal scans to the low voltage subpixel, allowing the source driving element 200 applies a first source driving signal to the low voltage subpixel. The first source driving signal is the source driving signal of a previous high voltage subpixel which is adjacent to the low voltage subpixel, in which, the driving time sequence of the sub-gate driving signal is the gate driving time sequence and the source driving time sequence corresponding to the previous high voltage sub-pixel which is adjacent to the low voltage subpixel.

The gate driving element 300, is configured to transmit the main gate driving signal to the low voltage subpixel arranged in the row direction, open a main gate switch corresponding to the low voltage subpixel, when the main gate driving signal scans to the low voltage sub-pixel, allowing the source driving element applies a second source driving signal to the low voltage subpixel. As such, the voltage strength of two adjacent pixels in the display array is different, which means that the two adjacent pixels are applied with high and low voltage strength respectively and alternatively. In which, the driving time sequence of the main gate driving signal is the original gate driving timing sequence corresponding to the low voltage sub-pixels in the row direction.

It should be noted that the voltage strength of sub-pixels includes low voltage (e.g. sub-pixel marked with L in FIG. 1) and high voltage (e.g. sub-pixel marked with H in FIG. 1).

It is understood that, the displayed gray scale associated with the subpixels with a high voltage is relatively bright, while displayed gray scale associated with the subpixels with a low voltage is relatively dark. As illustrated in FIG. 1, two adjacent pixels are arranged respectively and alternately with high and low voltage strengths.

In real practice, the gate driving element 300 of some embodiments simultaneously send in the row direction the sub-gate driving signal and the main gate driving signal to scan the low voltage subpixel.

Figure 3A:
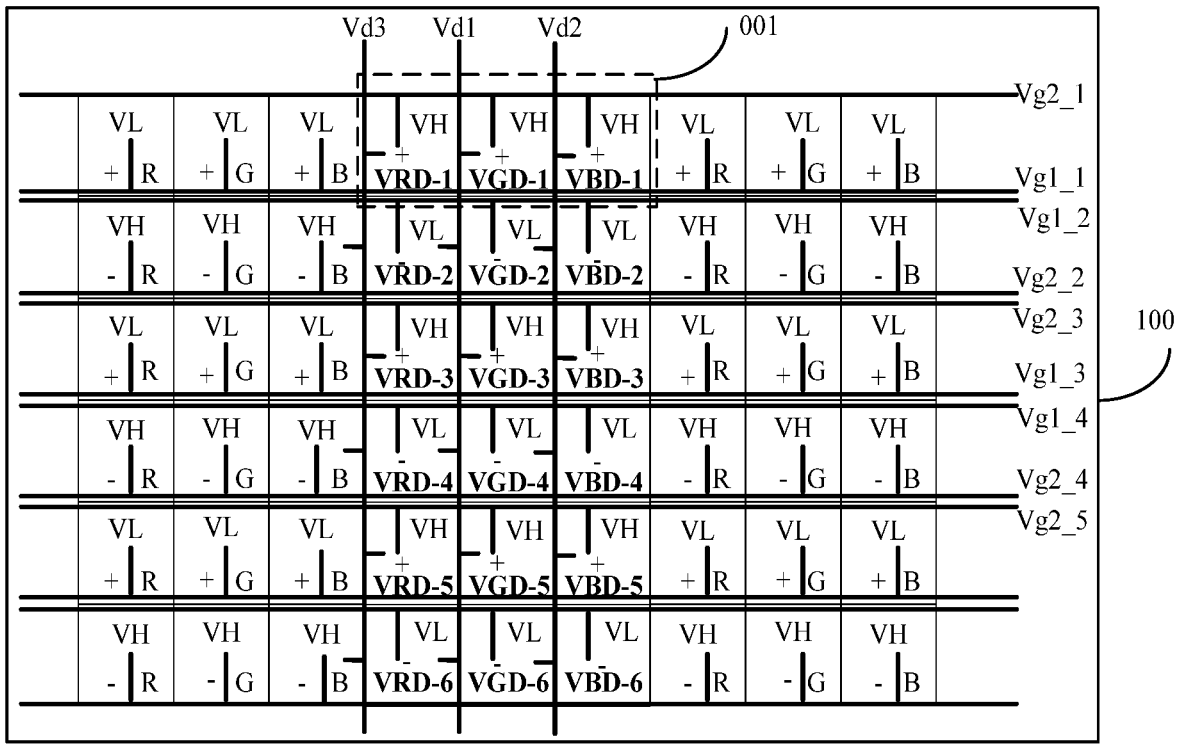
FIG. 3*a* is a schematic structural diagram regarding a first frame of a display array in some embodiments according to the present application.

Referring to FIG. 3*a*, in order to realize the alternative arrangement of the high and low voltage driving for the pixels in FIG. 1, two gate driving lines are designed for the same row of subpixels. One gate driving signal is Vg1_1, which is the common gate driving line and driving signal for subpixels of pixels in odd-numbered column of the first row shown in FIGS. 3*a* and 4*b*, and the other gate driving signal is Vg2_1, which is the common gate driving line and driving signal for subpixels of the pixels in the even-numbered row the first row.

Figure 4:
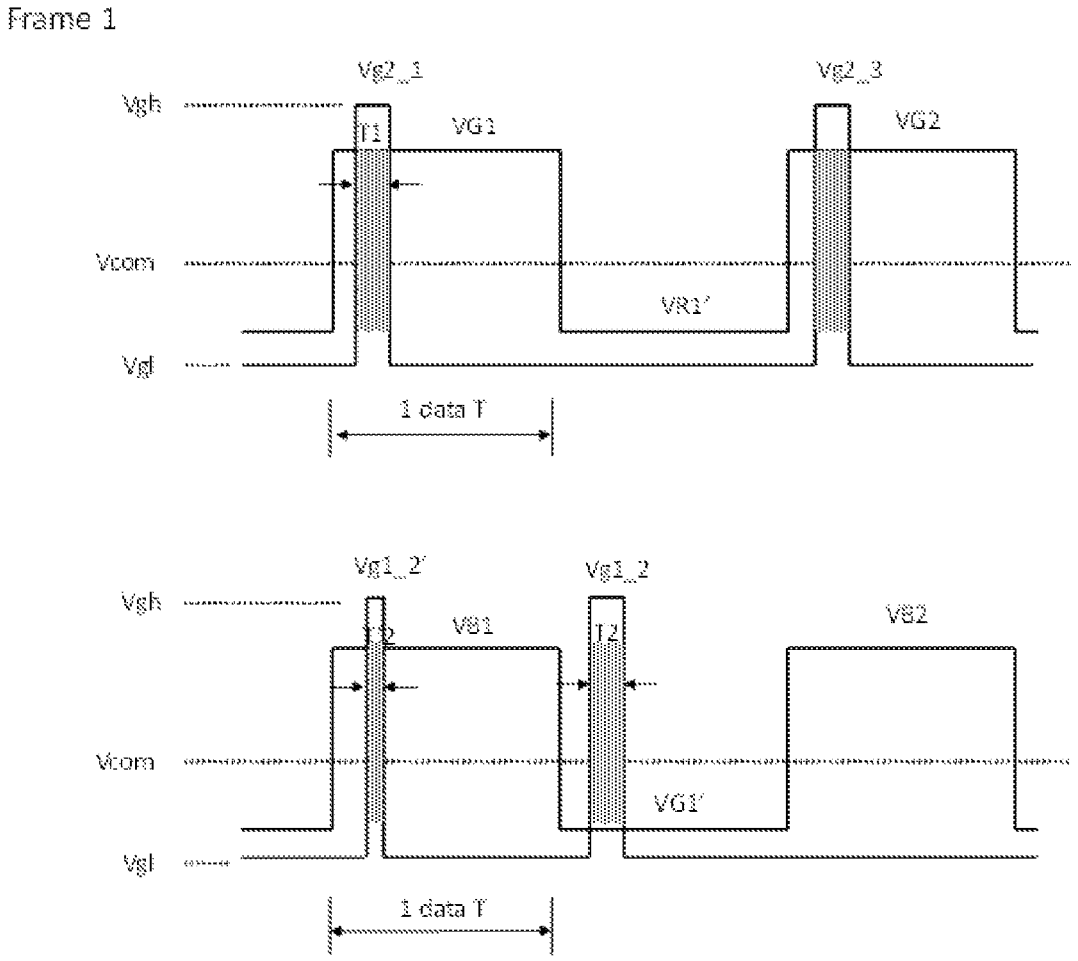
FIG. 4 is a schematic diagram regarding driving time sequence corresponding to the first frame in some embodiments according to the present application.

Meanwhile, referring to FIG. 4, which shows the timing sequence of the first frame Frame 1 of the display array. In some embodiments a source driving method with dot inversion is used, and the polarity of the driving voltage of the first source driving signal is opposite to the polarity of the driving voltage of the second source driving signal. The sub-pixel VGd_1 receives a high voltage positive driving signal VG1, and the corresponding gate driving signal of this sub-pixel is Vg2_1, and the corresponding source charging signal is VG1. VGd_2 sub-pixel receives a low voltage negative driving signal. Charging for this sub-pixel includes two time sequences. The first time sequence corresponds to gate driving signal Vg1_2', and the source charging signal is the positive charging voltage Vd2=VB1 associated with the previous sub-pixel VBd_1. The sub-pixel is pre-charged with the positive voltage, and the gate driving signal corresponding to the second time sequence is Vg1_2. The source signal for charging is the negative charging voltage Vd2=VG1' associated with the low voltage sub-pixel VGd_2, in which, the polarity of VG1' is opposite to that of VG1, i.e., VG1' is smaller than the common electrode voltage Vcom, while VG1 is greater than the common electrode voltage Vcom, and |VG1−Vcom|=|VG1'−Vcom|. The target negative charging signal VG1' is changed to VG1" through pre-positive charging. Since the source charging signal is changed from positive to positive negative, and the limitation of the charging capability of the element results in the load limitation of pixel voltage polarity switching which affects the pixel charging, the charging voltage of the low voltage subpixel VGd_2 at the end of the second charging time cannot completely reach the negative voltage VG1'. The switch T2' of the gate driving voltage Vg1_2' for positive charging is controlled smaller than the switch T2 of the gate driving voltage Vg1_2 for negative charging, so that the last negative charging signal VG1" of the low voltage subpixel has a difference with respect to the common electrode voltage Vcom, i.e., |VG1"−Vcom| is smaller than |VG1'−Vcom|, which means that, charging equivalent voltage of the low voltage subpixel |VG1"−Vcom| is smaller than the charging equivalent voltage of the high voltage sub-pixel |VG1−Vcom|. The source polarity of the low voltage subpixel is opposite to that of the high voltage sub-pixel. The charge of the low voltage subpixel is equivalently decreased relatively to that of the high voltage subpixel (the driving of the sub-pixel is based on the charge storage formed by the voltage difference between the driving voltage and the common electrode voltage). The subpixels on the two rows of gate driving lines have different charging capabilities for the same drive voltage, thus improving the color shift by driving the high voltage pixels and low voltage pixels as being arranged alternately in the display array. Switching (interchange) of timing gate scanning driving signals of the display arrays of adjacent frames, can make sub-pixels with different timing and high and low voltage signals in different display arrays. The difference between high voltage subpixels and low voltage subpixels cannot be distinguished obviously by naked eyes, preventing the defect of resolution reduction. Adjacent pixels in the same row can form high and low equivalent voltage driving to achieve the charging difference between high voltage subpixels and low voltage subpixels, improving the color shift.

Optionally, in some embodiments, the subpixels in an odd row in column i share a same source line with the subpixels in an even row in column i+1, in which i is odd, and one source line corresponds to one source driving signal.

It should be noted that, the subpixels in the ith column and the subpixels in the i+1th column are two adjacent columns of subpixels. In some embodiments, i=1, and the driving methods regarding to the subpixels R in the fourth column, the subpixels G in the fifth column, and the subpixels in the sixth column are described. That is, the driving methods are described taking the pixels in the second column as an example.

Figure 3B:
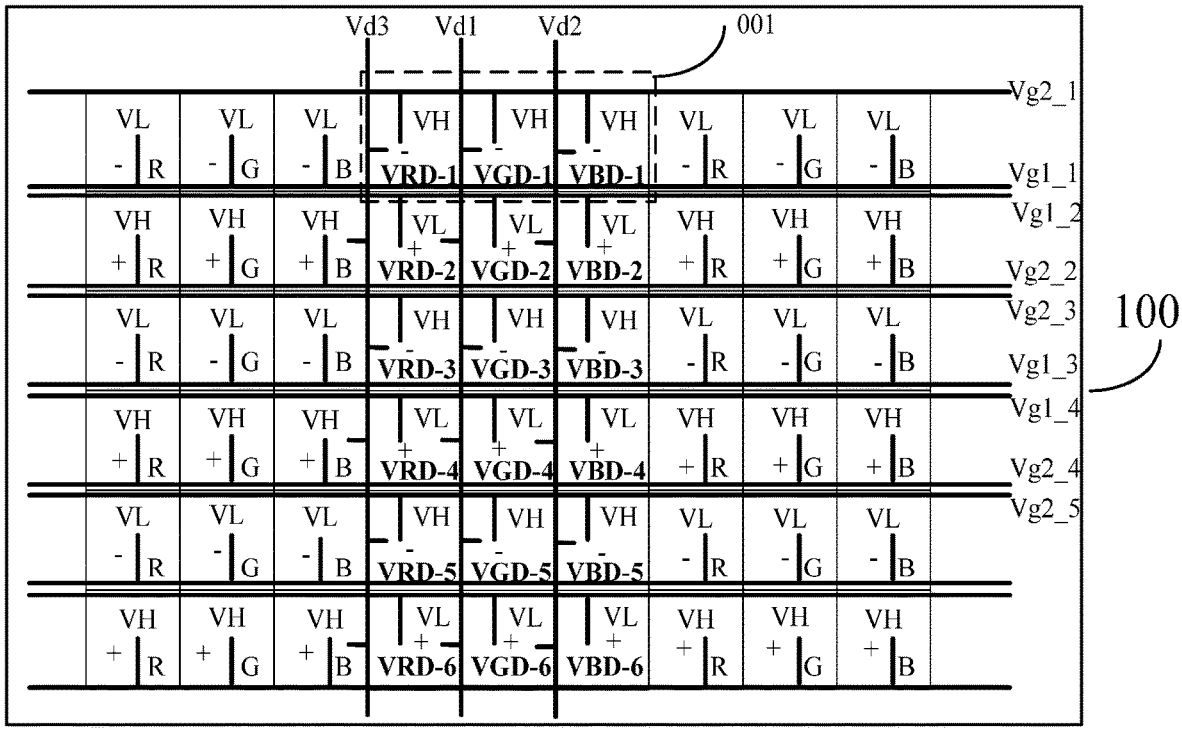
FIG. 3*b* is a schematic structural diagram regarding a second frame of a display array in some embodiments according to the present application.

In real practice, in FIG. 3*a* or FIG. 3*b*, Vd1, Vd2 and Vd3 respectively represent source lines, and one source line corresponds to one source driving signal. Taking FIG. 3*a* as an example, in which the Vd1 source line drives the subpixel G in the second column and the subpixel R in the first column of the pixel in the second column, which are sequentially the positive subpixel VGd_1, the negative subpixel VRd_2, the positive subpixel VGd_3, the negative subpixel VRd_4, the positive subpixel VGd_5, and the negative subpixel VRd_6. And their corresponding gate driving voltages are Vg2_1, Vg1_2, Vg2_3, Vg1_4, Vg2_5, Vg1_6, respectively. The Vd2 source line drives the subpixel G on the second column and the subpixel B on the third column. The gate driving voltages corresponding to the positive subpixel VBd_1, negative subpixel VGd_2, positive subpixel VBd_3, negative subpixel VGd_4, positive subpixel VBd_5, and negative subpixel VGd_6 are Vg2_1, Vg1_2, Vg2_3, Vg1_4, Vg2_5, Vg1_6 respectively, in which Vg2_1, Vg2_3, Vg2_5.

The gate switch timing is T1, Vg1_2, Vg1_4, Vg1_6 . . . for the charging time of the source driving signal, and the gate switch timing is two periods, one period is a period corresponding to the gate voltages Vg2_1, Vg2_3, Vg2_5 . . . of the previous adjacent sub-pixel, and the periods Vg1_2', Vg1_4', vg1_6' . . . .

The time for charging the gate voltage is T2', in which, T2' is less than T1/T2 charging period. The other period is Vg1_2, Vg1_4, Vg1_6 . . . the charging time of the gate charging voltage for the source driving signal is T2 and Vg2_1, Vg2_3, Vg2_5 . . . the gate switching timing can be the same for the charging time of the source driving signal T1, or the gate switching time when T2 is not equal to T1 can be adjusted, and can be adjusted according to the element charging capability.

Figure 5:
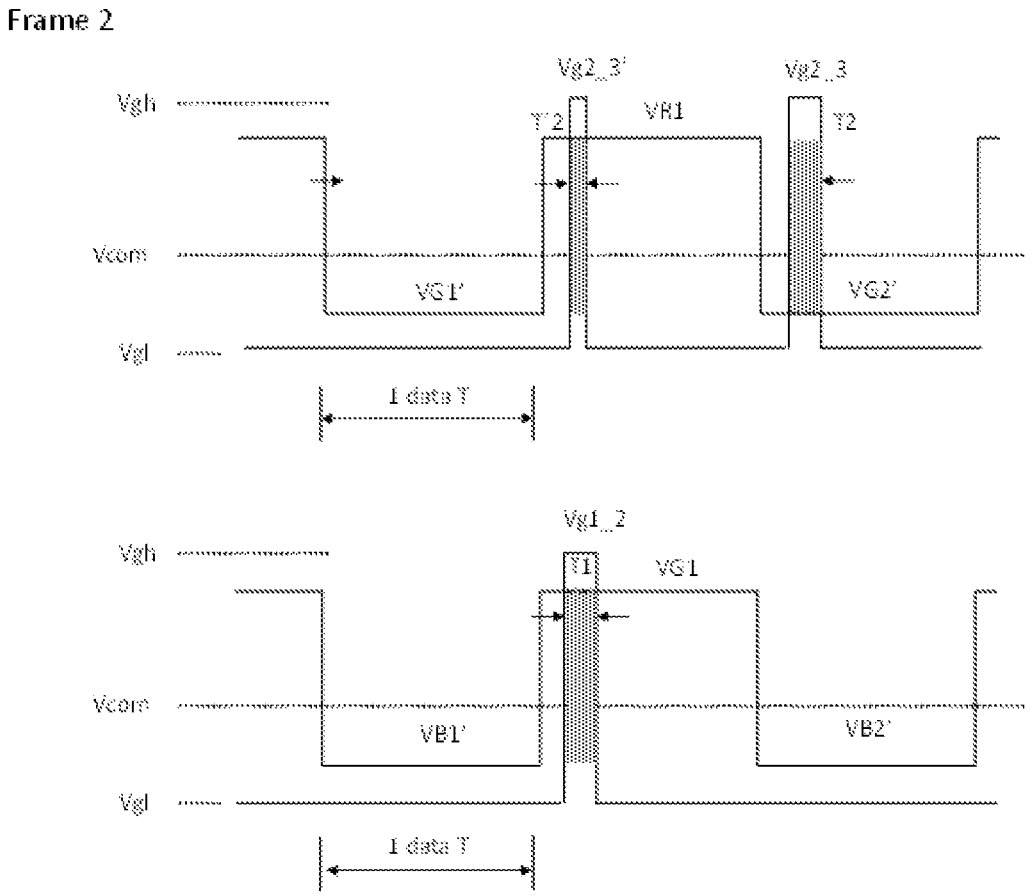
FIG. 5 is a schematic diagram of a driving time sequence corresponding to the second frame in some embodiments of the present application.

Optionally, referring to FIG. 5, with the inversion of the driving signals of the images Frame 1 and Frame 2 corresponding to the display arrays of two adjacent frames, the gate switch switches the charging time sequence of the source driving signals, i.e., Vg2_1, Vg2_3, Vg2_5 . . . , the gate switch timing is in two periods, one is a period corresponding to the source driving signal of the previous adjacent subpixel, which are respectively Vg2_1', Vg2_3', Vg2_5' . . . , with a precharge time T2', in which T2' is less than T1/T2 charging period. The other periods correspond to the source signals Vg2_1, Vg2_3, Vg2_5 . . . , in which the charging times for the source driving signal are T2. And Vg1_2, Vg1_4, Vg1_6 . . . .

The charging time of the gate switching timing for the source driving signal can be the same as T1, or the charging time can be different to T1, depending on the charging capacity of the element. It can make sub-pixels with different timing and high and low voltage signals in display arrays of different frames. The difference between high voltage subpixels and low voltage subpixels cannot be distinguished obviously by naked eyes, preventing the defect of resolution reduction.

Two adjacent subpixels are driven in a same column by the preset data driving signal, the preset data driving signal being an average of historical driving signals of two subpixels that are adjacent.

The equivalent voltages of sub-pixels VGd_1 and VGd_2 in row G are respectively positive driving voltage Vd1=VG1 and negative driving voltage Vd2=VG1'. And the positive driving voltage VG1 and negative driving voltage VG1' can be selected as the average signals of the original display array pixel signals Gd1 and Gd2 (0-255 signals in terms of 8 bit driving signals), namely G1=(Gd1+Gd2)/2, corresponding to the positive driving voltage VG1 and negative driving voltage VG1'. The equivalent voltages of VGd_3 and VGd_4 are respectively driven by the positive driving voltage Vd1=VG2 and the negative driving voltage Vd2=VG2', and can be selected as the average signals of the original display array pixel signals Gd3 and Gd4 (0-255 signals in terms of 8-bit driving signals), namely G2=(Gd3+

Gd4)/2, which is corresponding to the positive driving voltage VG2 and the negative driving voltage VG2'.

Further, given from the time sequence illustrated in FIG. 4, the subpixel positive driving signals are VG1, VG2, VG3, . . . , while the subpixel negative driving signals are VG1', VG2', VG3' . . . . The time sequence of the Frame 1 in FIG. 4 shows that the source driving signals are sub-pixels VGd_1, VGd_2, VGd_3, . . . , the subpixel voltage driving signals are VG1, VG1', VG2, VG2' . . . , the gate voltage sequentially turns on and charges the sub-pixels VGd_1, VGd_2, VGd_3, . . . , in which, the gate voltage of the high voltage subpixel VGd_1 is Vg2_1, and the gate voltage of the low voltage subpixel VGd_2 are Vg1_2 and Vg1_2', in which the gate voltage of the high voltage subpixel VGd_1 is set to Vg2_1, while the gate voltage of the low voltage sub-pixel VGd_2 is set to Vg1_2'. The gate voltage of the low voltage subpixel VGd_2 is set as follows: the time for switching on the gate voltage of Vg1_2 and Vg1_2' are different. The gate voltage of the low voltage sub-pixel VGd_2 is set as Vg1_2 with the T2 which can be equal to T1 of the gate voltage Vg1 of the high voltage sub-pixel VGd_1, i.e., T1=T2, or T2 can be not equal to T1 and adjusted based on the charging capability of the element. The gate precharge voltage of the low voltage subpixel VGd_2 is set as Vg1_2' with a time T2' which can be less than T1 associated with the gate voltage Vg2_1 of the high voltage subpixel VGd_1, and less than T2 associated with the gate voltage Vg1_2 of the low voltage subpixel VGd_2, i.e., T2'<T1 and T2'<T2.

The high voltage subpixel VGd_1 is charged with the positive source driving signal Vd1=VG1 as well as Vg2_1 for the gate switch time T1. Regarding to its adjacent subpixel VGd_2, the charging includes two periods. The first charging period is T1 associated with the gate opening time for the previous high voltage subpixel VBd_1, and the source driving signal is associated with the high voltage subpixel VBd_1 with the positive source driving signal Vd2=VB1. In the meanwhile, the sub-pixel VGd_2 is charged by the opened the gate driving voltage Vg1_2'. The gate driving voltage Vg1_2' and that gate driving voltage Vg2_1 corresponding to the high voltage subpixel VBd_1 are simultaneously switched on to charge the subpixel VBd_1 and to precharge the subpixel VGd_2. And it is designed that the T2' of the gate driving voltage Vg1_2' to be smaller than time T1/T2 associated with the gate driving voltage Vg2_1/Vg1_2.

The second charging period is to charge the subpixel VGd_2 for gate switch T2 with the negative driving voltages Vd2=VG1' and Vg1_2. The charging voltage is the positive polarity voltage VB1 of the low voltage subpixel VGd_2 at the first charging time, the charging time T2' of the control gate voltage Vg1_2' is controlled to be less than the charging time T2 of the gate voltage Vg1_2. The charging voltage is the negative voltage VG1' of the low voltage subpixel VGd_2 at the second charging time. Because of the pre-charging with the positive voltage VG", as well as the charging time T2 in the second charging time of the gate voltage Vg1_2, the sub-pixel VGd_2 is switched from precharged positive voltage VB1 to negative voltage VG1'. Limited by element capability, load limitation of pixel voltage polarity switching affects pixel charging, such that the final charging voltage of low voltage sub-pixel VGd_2 at the second charging time cannot completely reach negative voltage VG1', and the equivalent charging voltage of the final low voltage sub-pixel VGd_2 is less than |VG1'−Vcom|, ensuring that the charging voltage of low voltage sub-pixel VGd_2 is less than that of the high voltage subpixel VGd_1, |VG1−Vcom|. Adjacent subpixels in the same row can form high and low equivalent voltage driving to achieve the charging difference between high voltage subpixels and low voltage subpixels, improving the color shift.

It can be understood that from the time sequence illustrated in FIG. 5, the polarity of the subpixels of the display array and the time driving switched between high and low voltages are shown, the positive polarity driving signals VG1, VG2, VG3, . . . , and the negative polarity driving signals VG1', VG2', VG3' . . . . The time sequence of the Frame 2 in FIG. 5 shows that the source driving signals are sub-pixels VGd_1, VGd_2, VGd_3, . . . , the subpixel voltage driving signals are VG1', VG1, VG2', VG2, . . . , the gate voltage sequentially switches on and charges the sub-pixels VGd_1, VGd_2, VGd_3, . . . , in which, the gate voltage of the low voltage subpixel VGd_3 is Vg2_3 and Vg2_3', and the gate voltage of the high voltage subpixel VGd_2 are Vg1_2. The gate voltage of the low voltage subpixel VGd_3 is set as follows: the time for switching on the gate voltage of Vg2_3 and Vg2_3' are different. The gate voltage of the low voltage sub-pixel VGd_3 is set as Vg2_3 with the T2 which can be equal to T1 of the gate voltage Vg1_2 of the high voltage sub-pixel VGd_2, i.e., T1=T2, or T2 can be not equal to T1 and adjusted based on the charging capability of the element. When the gate voltage of the low voltage sub-pixel VGd_3 is Vg2_3', T2' is smaller than the gate voltage Vg1_2 on time T1 of the high voltage sub-pixel VGd_2, i.e., T2'<T1. In which, the gate voltage of the low voltage subpixel VGd_3 is Vg2_3' on while the gate voltage of the high voltage subpixel VGd_2 is Vg1_2 on.

Correspondingly, the high voltage subpixel VGd_2 is to charge the high voltage subpixel VGd_2 with the positive source driving signals Vd2=VG1 with switch time T1 and signal Vg1_2. Regarding to its adjacent subpixel VGd_3, the charging includes two periods. The first charging period is T1 associated with the gate opening time for the previous high voltage subpixel VGd_2, and the source driving signal is associated with the high voltage subpixel VRd_2 with the positive source driving signal Vd1=VR1. In the meanwhile, the sub-pixel VGd_3 is charged by the opened the gate driving voltage Vg2_3'. The gate driving voltage Vg2_3' and that gate driving voltage Vg2_3' corresponding to the high voltage subpixel VRd_2 are simultaneously switched on to charge the subpixel VRd_2 and to precharge the subpixel VGd_3. And it is designed that the T2' of the gate driving voltage Vg2_4' to be smaller than time T1/T2 associated with the gate driving voltage Vg1_2/Vg2_3.

The second charging period is to charge the subpixel VGd_3 with the negative driving voltages Vd1=VG2' and Vg2_3 for gate switch T2. The charging voltage is the positive polarity voltage VR1 of the low voltage subpixel VGd_3 at the first charging time, the charging time T2' of the control gate voltage Vg2_3' is controlled to be less than the charging time T2 of the gate voltage Vg2_3. The charging voltage is the negative voltage VG2' of the low voltage subpixel VGd_3 at the second charging time. Because of the pre-charging with the positive voltage VG", as well as the charging time T2 in the second charging time of the gate voltage VG2_3, the sub-pixel VGd_3 is switched from precharged positive voltage VR1 to negative voltage VG2'. Limited by element capability, load limitation of pixel voltage polarity switching affects pixel charging, such that the final charging voltage of low voltage sub-pixel VGd_3 at the second charging time cannot completely reach negative voltage VG1', and the equivalent charging voltage of the final low voltage sub-pixel VGd_3 is less than |VG2'−

Vcom|, ensuring that the charging voltage of low voltage sub-pixel VGd_3 is less than that of the high voltage subpixel VGd_4, |VG2−Vcom|. Adjacent subpixels in the same row can form high and low equivalent voltage driving to achieve the charging difference between high voltage subpixels and low voltage subpixels, improving the color shift.

Figure 2:
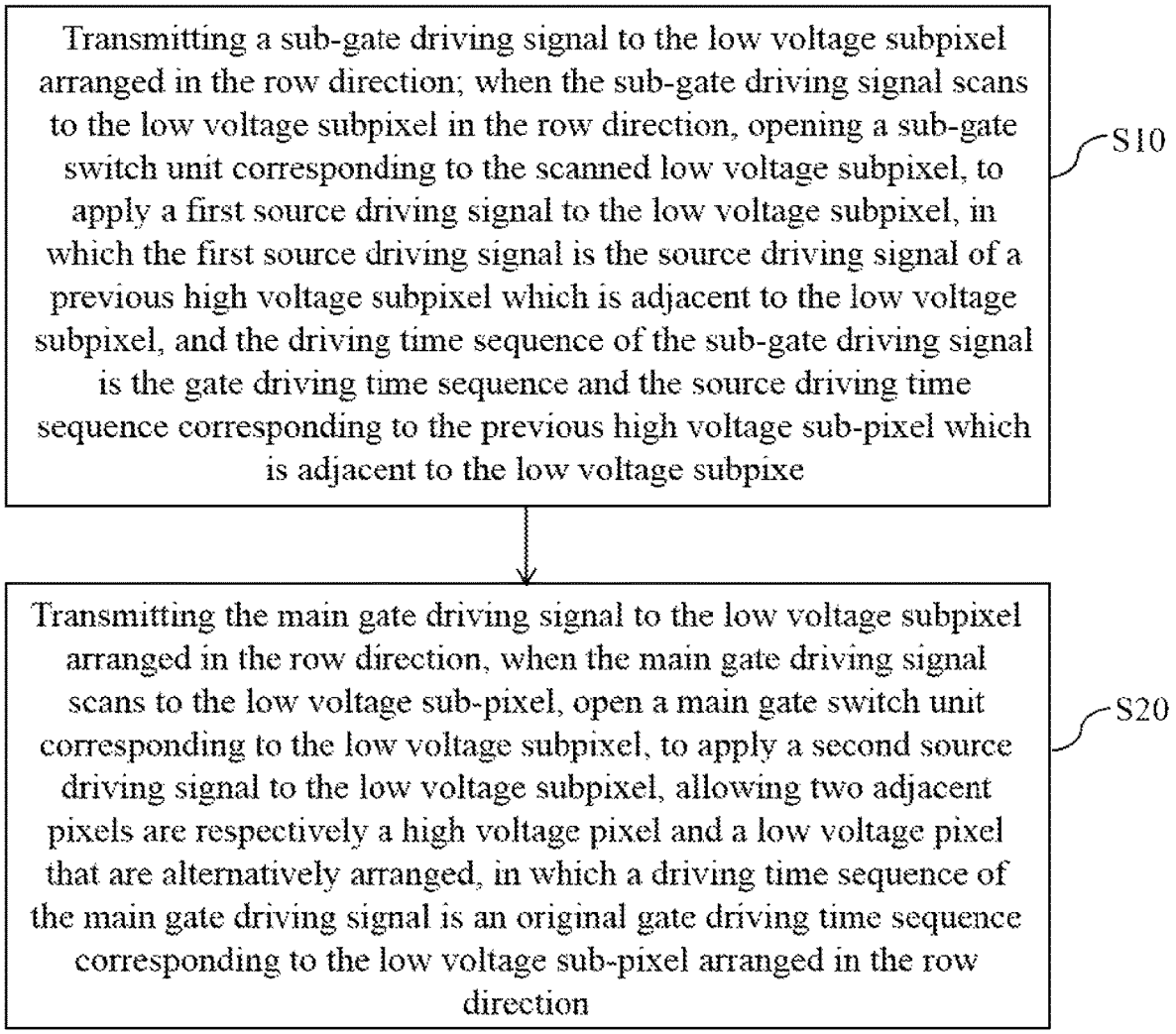
FIG. 2 is a schematic flow chart regarding a driving method for a display panel in some embodiments according to the present application.

In addition, referring to FIG. 2, the present application further provides a driving method of the display panel. FIG. 2 is a schematic flow chart regarding a driving method for a display panel in some embodiments according to the present application.

In some embodiments, the display panel includes a display array which includes pixels arranged in an array. Each pixel includes three subpixels sequentially arranged in a row direction, and pixels in an odd-numbered column have different gate driving signals as pixels in an even-numbered column in the row direction. The different gate driving signals includes a main gate driving signal and a signal combining the main gate driving signal and the sub-gate driving signal.

Accordingly, the driving method includes:

Step S10, transmitting a sub-gate driving signal to the low voltage subpixel arranged in the row direction; when the sub-gate driving signal scans to the low voltage subpixel in the row direction, opening a sub-gate switch corresponding to the scanned low voltage subpixel, to apply a first source driving signal to the low voltage subpixel, in which the first source driving signal is the source driving signal of a previous high voltage subpixel which is adjacent to the low voltage subpixel, and the driving time sequence of the sub-gate driving signal is the gate driving time sequence and the source driving time sequence corresponding to the previous high voltage sub-pixel which is adjacent to the low voltage subpixel.

Step S20, transmitting the main gate driving signal to the low voltage subpixel arranged in the row direction, when the main gate driving signal scans to the low voltage sub-pixel, open a main gate switch corresponding to the low voltage subpixel, to apply a second source driving signal to the low voltage subpixel, allowing two adjacent pixels are respectively a high voltage pixel and a low voltage pixel that are alternatively arranged, in which a driving time sequence of the main gate driving signal is an original gate driving time sequence corresponding to the low voltage sub-pixel arranged in the row direction.

It should be noted that step S10 and step S20 in some embodiments are implemented simultaneously, which means, the sub-gate driving signal and the main gate driving signal are switched on simultaneously to scan the low voltage subpixel. The polarity of a driving voltage of the first source driving signal is opposite to polarity of a driving voltage of the second source driving signal. As illustrated in FIG. 3*a* or FIG. 3*b*, the polarity of a same row of subpixels is the same, and the polarity of adjacent two rows of subpixels is opposite.

In some embodiments, referring to FIG. 3*a* or FIG. 3*b*, the subpixels in an odd row in column i share a same source line with the subpixels in an even row in column i+1, in which i is odd, and one source line corresponds to one source driving signal.

The specific implementation of the driving method of the display panel in some embodiments can be referred to the embodiment of the driving device of the display panel, which will not be described herein.

According to the embodiments, the display array of the display panel has two kinds of gate driving lines for sub-pixels in the same row. The pixels in the odd-numbered column has a different gate driving signals with those in the even-numbered column. The driving time sequence of the main gate driving signals is the original gates driving time sequence corresponding to the low voltage subpixels in the row direction, and the driving time sequence of the sub-gate driving signals is the gate driving time sequence and the source driving time sequence corresponding to the previous high voltage subpixels that is adjacent to the low voltage subpixels. As such, the charging capability is different of sub-pixels on two adjacent rows of gate driving lines for the same drive voltage, and adjacent pixels are applied with high and low voltage intensities respectively and alternatively. The difference between high voltage subpixels and low voltage subpixels cannot be obviously distinguished by naked eyes, preventing the resolution from being lowered.

In addition, the present application further provides a display apparatus, which includes a display panel as well as a driving device as described above.

The display panel includes a display array which includes pixels arranged in an array. Each pixel includes three sub-pixels sequentially arranged in a row direction, and pixels in an odd-numbered column have different gate driving signals as pixels in an even-numbered column in the row direction. The different gate driving signals includes a main gate driving signal and a signal combining the main gate driving signal and the sub-gate driving signal.

The display apparatus is provided with a processor, a memory and a driving program stored on the memory and operable on the processor regarding to a display panel, in which the driving program of the display panel is configured to implement the operations of the driving method of the display panel as described above.

The description aforementioned is only the preferred embodiment of the present application and is not intended to limit the scope of the present application. Any equivalent structural modification made by using the description and drawings of the present application or direct/indirect application in other related technical fields under the concept of the present application shall be included in the protection scope of the present application.

What is claimed is:

1. A driving device of a display panel, wherein the display panel comprises a display array, the display array comprising pixels arranged in an array, each pixel comprising three subpixels sequentially arranged in a row direction, pixels in an odd-numbered column having different gate driving signals as pixels in an even-numbered column in the row direction, the different gate driving signals comprising a main gate driving signal and a signal combining the main gate driving signal and a sub-gate driving signal, high voltage subpixel employing the main gate driving signal, low voltage subpixel employing the signal combining the main gate driving signal and the sub-gate driving signal; and the driving device comprises a gate driving element and a source driving element, wherein the gate driving element is configured to transmit a sub-gate driving signal to the low voltage subpixel arranged in the row direction, and open a sub-gate switch corresponding to the low voltage subpixel when the low voltage subpixel is scanned by the sub-gate driving signal, allowing a first source driving signal of the source driving element to be applied to the low voltage subpixel, the first source driving signal being the source driving signal of a previous high voltage subpixel which is adjacent to the low voltage subpixel, wherein the driving time sequence of the sub-gate driving signal is the gate driving time sequence and the source driving time sequence corresponding to the previous high voltage sub-pixel which is adjacent to the low voltage subpixel; and the gate driving element is configured to transmit the main gate driving signal to the low voltage subpixel arranged in the row direction, and open a main gate switch corresponding to the low voltage subpixel when the low voltage sub-pixel is scanned by the main gate driving signal, allowing a second source driving signal of the source driving element to be applied to the low voltage subpixel; wherein a driving time sequence of the main gate driving signal is an original gate driving time sequence corresponding to the low voltage sub-pixel arranged in the row direction.

2. The driving device of claim 1, wherein the gate driving element is further configured to simultaneously send in the row direction the sub-gate driving signal and the main gate driving signal to scan the low voltage sub-pixel.

3. The driving device of claim 1, wherein the subpixels in an odd row in column i share a same source line with the subpixels in an even row in column i+1, in which i is odd, and one source line corresponds to one source driving signal.

4. The driving device of claim 1, wherein the subpixels in an odd row in column i share a same source line with the subpixels in an even row in column i+1, in which i is odd, and one source line corresponds to one source driving signal;

the gate driving element, is further configured to simultaneously send in the row direction the sub-gate driving signal and the main gate driving signal to scan the low voltage sub-pixel.

5. The driving device of claim 4, wherein polarity of a driving voltage of the first source driving signal is opposite to polarity of a driving voltage of the second source driving signal.

6. The driving device of claim 5, wherein polarity of subpixels in a same row is the same, and the polarity of subpixels at two adjacent rows is opposite.

7. A driving method of a display panel, wherein the display panel comprises a display array comprising pixels arranged in an array, each pixel comprising three subpixels sequentially arranged in a row direction, pixels in an odd-numbered column having different gate driving signals as pixels in an even-numbered column in the row direction, the different gate driving signals comprising a main gate driving signal and a signal combining the main gate driving signal and the sub-gate driving signal;

the driving method comprises:

transmitting a sub-gate driving signal to the low voltage subpixel arranged in the row direction, and opening a sub-gate switch corresponding to the low voltage sub-pixel when the low voltage subpixel is scanned by the sub-gate driving signal, to apply a first source driving signal to the low voltage subpixel, the first source driving signal being the source driving signal of a previous high voltage subpixel which is adjacent to the low voltage subpixel, wherein the driving time sequence of the sub-gate driving signal is the gate driving time sequence and the source driving time sequence corresponding to the previous high voltage sub-pixel which is adjacent to the low voltage subpixel; and transmitting the main gate driving signal to the low voltage subpixel arranged in the row direction, and opening a main gate switch corresponding to the low voltage subpixel when the low voltage sub-pixel is scanned by the main gate driving signal, to apply a second source driving signal to the low voltage sub-pixel, allowing two adjacent pixels are respectively a high voltage pixel and a low voltage pixel, wherein a driving time sequence of the main gate driving signal is an original gate driving time sequence corresponding to the low voltage sub-pixel arranged in the row direction.

8. The method of claim 7, wherein the sub-gate driving signal and the main gate driving signal are switched on simultaneously to scan the low voltage subpixel.

9. The driving method of claim 8, wherein the subpixels in an odd row in column i share a same source line with the subpixels in an even row in column i+1, in which i is odd, and one source line corresponds to one source driving signal.

10. The driving method of claim 7, wherein the sub-gate driving signal and the main gate driving signal are switched on simultaneously to scan the low voltage subpixel, the subpixels in an odd row in column i share a same source line with the subpixels in an even row in column i+1, in which i is odd, and one source line corresponds to one source driving signal.

11. The driving method of claim 10, wherein polarity of a driving voltage of the first source driving signal is opposite to polarity of a driving voltage of the second source driving signal.

12. The driving method of claim 11, wherein polarity of subpixels in a same row is the same, and the polarity of subpixels at two adjacent rows is opposite.

13. The driving method of claim 7, wherein the driving method further comprises:

driving two adjacent subpixels in a same column by the preset data driving signal, the preset data driving signal being an average of historical driving signals of two sub-pixels that are adjacent.

14. A display apparatus, comprising a display panel and a display device of the display panel, the display panel comprising a display array which comprises pixels arranged in an array, each pixel comprising three subpixels sequentially arranged in a row direction, pixels in an odd-numbered column having different gate driving signals as pixels in an even-numbered column in the row direction, the different gate driving signals comprising a main gate driving signal and a signal combining the main gate driving signal and the sub-gate driving signal.

15. The display apparatus of claim 14, wherein the driving device of the display panel comprises a processor and a memory, the memory storing executable instructions, the processor executing the executable instructions to implement:

transmitting a sub-gate driving signal to the low voltage subpixel arranged in the row direction; opening a sub-gate switch corresponding to the scanned low voltage subpixel when the sub-gate driving signal scans to the low voltage subpixel in the row direction, to apply a first source driving signal to the low voltage subpixel, the first source driving signal being the source driving signal of a previous high voltage subpixel which is adjacent to the low voltage subpixel, wherein the driving time sequence of the sub-gate driving signal is the gate driving time sequence and the source driving time sequence corresponding to the previous high voltage sub-pixel which is adjacent to the low voltage subpixel; and transmitting the main gate driving signal to the low voltage subpixel arranged in the row direction, open a main gate switch corresponding to the low voltage subpixel when the main gate driving signal scans to the low voltage sub-pixel, to apply a second source driving signal to the low voltage subpixel, allowing two adjacent pixels are respectively a high voltage pixel and a low voltage pixel that are alternatively arranged, wherein a driving time sequence of the main gate driving signal is an original gate driving time sequence corresponding to the low voltage sub-pixel arranged in the row direction.

16. The display apparatus of claim 15, wherein the processor executes the executable instructions to further implement:

simultaneously sending in the row direction the sub-gate driving signal and the main gate driving signal to scan the low voltage sub-pixel.

17. The driving apparatus of claim 16, wherein the subpixels in an odd row in column i share a same source line with the subpixels in an even row in column i+1, in which i is odd, and one source line corresponds to one source driving signal.

18. The driving apparatus of claim 17, wherein polarity of a driving voltage of the first source driving signal is opposite to polarity of a driving voltage of the second source driving signal.

19. The driving apparatus of claim 18, wherein polarity of subpixels in a same row is the same, and the polarity of subpixels at two adjacent rows is opposite.

20. The display apparatus of claim 15, wherein the processor executes the executable instructions to further implement:

driving two adjacent subpixels in a same column by the preset data driving signal, the preset data driving signal being an average of historical driving signals of two sub-pixels that are adjacent.

* * * * *